US009543060B2

(12) United States Patent
Konnik

(10) Patent No.: US 9,543,060 B2
(45) Date of Patent: Jan. 10, 2017

(54) HIGH-TEMPERATURE CABLE HAVING INORGANIC MATERIAL

(71) Applicant: Rockbestos Surprenant Cable Corp., East Granby, CT (US)

(72) Inventor: Robert Konnik, South Windsor, CT (US)

(73) Assignee: Rockbestos Suprenant Cable Corp., East Granby, CT (US)

( * ) Notice: Subject to any disclaimer, the term of this patent is extended or adjusted under 35 U.S.C. 154(b) by 0 days.

(21) Appl. No.: 13/688,806

(22) Filed: Nov. 29, 2012

(65) Prior Publication Data

US 2013/0133918 A1 May 30, 2013

Related U.S. Application Data

(60) Provisional application No. 61/565,193, filed on Nov. 30, 2011.

(51) Int. Cl.

| | |
|---|---|
| ***H01B 7/29*** | (2006.01) |
| ***H01B 13/26*** | (2006.01) |
| *H01B 7/04* | (2006.01) |

(52) U.S. Cl.

CPC ..... *H01B 7/292* (2013.01); *H01B 13/26* (2013.01); *H01B 7/046* (2013.01); *Y10T 29/49117* (2015.01)

(58) Field of Classification Search

CPC ..... H01B 7/292; H01B 7/042; H01B 7/0225; H01B 7/0241; H01B 7/025; H01B 7/0258; H01B 7/0266; H01B 7/29; H01B 3/02; H01B 3/04; H01B 3/08; H01B 13/26

USPC ..... 174/102 R, 105 R, 110 R, 120 R

See application file for complete search history.

(56) References Cited

U.S. PATENT DOCUMENTS

| | | | | |
|---|---|---|---|---|
| 2,192,892 | A | 3/1940 | Brandt | |
| 3,065,533 | A | 11/1962 | Dungan et al. | |
| 3,900,701 | A * | 8/1975 | Bayles et al. | 174/102 R |
| 4,051,324 | A * | 9/1977 | Anderson et al. | 174/121 R |
| 4,806,416 | A | 2/1989 | Puzo | |
| 4,935,583 | A | 6/1990 | Kyle | |
| 5,410,106 | A | 4/1995 | Nishino et al. | |
| 5,917,150 | A | 6/1999 | Hampton et al. | |
| 6,229,093 | B1 | 5/2001 | Hafele | |
| 6,852,412 | B2 | 2/2005 | Keogh | |
| 6,875,927 | B2 | 4/2005 | Brown et al. | |
| 6,998,536 | B2 | 2/2006 | Barusseau et al. | |
| 7,466,887 | B2 | 12/2008 | Castellani et al. | |
| 8,113,273 | B2 * | 2/2012 | Manke et al. | 166/66.4 |
| 2008/0273852 | A1 | 11/2008 | Parker et al. | |

FOREIGN PATENT DOCUMENTS

| | | |
|---|---|---|
| DE | 794338 | 4/1958 |
| DE | 987514 | 3/1965 |
| DE | 1225368 | 3/1971 |
| GB | 1225368 A * | 3/1971 |

* cited by examiner

*Primary Examiner* — Timothy Thompson
*Assistant Examiner* — Amol Patel
(74) *Attorney, Agent, or Firm* — Hayes Soloway

(57) ABSTRACT

A high-temperature cable and a method of making the same is provided. The high-temperature cable includes at least one conductor. An inorganic tape is wrapped around the at least one conductor. An armor shell is applied exterior of the inorganic tape.

19 Claims, 4 Drawing Sheets

HIGH-TEMPERATURE CABLE HAVING INORGANIC MATERIAL

CROSS REFERENCE TO RELATED APPLICATION

This application claims benefit of U.S. Provisional Application Ser. No. 61/565,193 entitled, "High-Temperature Cable having Inorganic Wrapped Layer" filed Nov. 30, 2011, the entire disclosure of which is incorporated herein by reference.

FIELD OF THE DISCLOSURE

The present disclosure is generally related to cables and more particularly is related to a high-temperature cable having an inorganic wrapped layer.

BACKGROUND OF THE DISCLOSURE

Elongated cables are found in use in many industries including those that conduct deep drilling, such as within the oil drilling industry. These cables may be used to transmit information and data from a drilling region having the drilling equipment to a control center located remote to the drilling region. Many oil-drilling regions are located deep within the Earth's crust, such as those seen with onshore and offshore drilling. The drilling region may be 5,000 feet or more from a control center located on the Earth's surface or a control center located on water at sea level. A cable of 5,000 feet or more may have a high weight that, when located vertically down a drilling hole distorts the structure of the cable itself. This may result in a failure of the cable or a deformity of the cable that renders it more inefficient than a non-deformed cable.

It is common for cables used in industries today to be subjected to high-temperature applications, as well as potential damaging situations. For example, cables may be subject to high temperatures from oil drilling operations, equipment, or other devices that may create heat. A metal casing is often used around the cable to help prevent transfer of the heat into the inner components of the cable. This metal casing, for example, may seal off any gassing of the inner materials of the cable, as well as prevent rocks, sharp objects, or other potentially damaging items from causing harm to the cable. When subjected to heat, many materials will deform or give off volatiles that will lower the insulation resistance of the insulating materials, especially when temperatures exceed 250° C. Materials such as perfluoroalkoxy (PFA) may be used up to temperatures of approximately 250° C., but may be unsuccessful in higher temperature.

Thus, a heretofore unaddressed need exists in the industry to address the aforementioned deficiencies and inadequacies.

SUMMARY OF THE DISCLOSURE

Embodiments of the present disclosure provide a system and method for a high-temperature cable. Briefly described, in architecture, one embodiment of the system, among others, can be implemented as follows. The high-temperature cable includes at least one conductor. An inorganic tape is wrapped around the at least one conductor. An armor shell is applied exterior of the inorganic tape.

The present disclosure can also be viewed as providing methods of making a high-temperature cable. In this regard, one embodiment of such a method, among others, can be broadly summarized by the following steps: wrapping at least one conductor with an inorganic tape formed from an inorganic material; and applying an armor shell exterior of the inorganic tape, thereby jacketing the inorganic tape and the at least one conductor.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
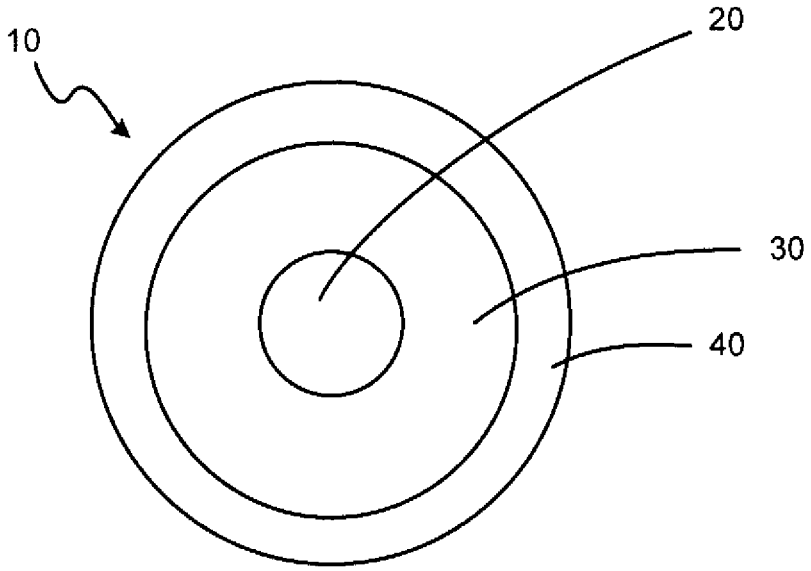
FIG. 1 is a cross-sectional illustration of a high-temperature cable, in accordance with a first exemplary embodiment of the present disclosure.

FIG. 1 is a cross-sectional illustration of a high-temperature cable 10, in accordance with a first exemplary embodiment of the present disclosure. The high-temperature cable 10, which may be referred to simply as 'cable 10,' includes at least one conductor 20. An inorganic tape 30 is wrapped around the at least one conductor 20. An armor shell 40 is applied exterior of the inorganic tape 30.

The cable 10 may be any wire, transmission line or similar structure that may be used in deep drilling operations, such as with onshore or offshore oil drilling. The at least one conductor 20 may include any material, which is capable of facilitating movement of electric charges, light or any other communication medium. The at least one conductor 20 may include conductor materials such as copper, aluminum, alloys, fiber electric hybrid materials, fiber optical material or any other material known within the industry. The at least one conductor 20 may be capable of facilitating movement of energy capable of powering a device or facilitating a communication or control signal between devices. The at least one conductor 20 may be located at substantially the center of the cable 10, but may also be located off-center or in another position as well.

It is noted that the cable 10, as well as the cables described relative to the other embodiments of this disclosure, may include a plurality (not shown) of conductors 20, such as two or more solid conductor materials, or many conductors 20 formed from varying conducting materials. The plurality of the conductors 20 may facilitate the transmission of electrical energy through the cable 10, or may facilitate communication of control signals through the cable 10. Any number conductors 20 may be included with the cable 10, configured in any orientation or fashion, such as conductors 20 bound together or woven together. The inorganic tape 30 may be applied to any number of the conductors 20 as a whole, individually to each conductor 20 within the cable, or to a bundle or grouping of a portion of the conductors 20.

An inorganic tape 30 may be positioned to fully surround the at least one conductor 20. When the inorganic tape 30 is positioned surrounding the at least one conductor 20, the cable 20 may provide many benefits within high-temperature environments, i.e., with temperatures at or in excess of 250° C. The inorganic tape 30 may include a variety of inorganic materials, such as a mica tape that is applied over the at least one conductor 20. The inorganic tapes 30 may prove successful for applications between 250° C. and 550° C., but may also be successful in temperatures beyond 550° C.

The inorganic tape 30 may also be configured as a braid or other wrapping that is applied to the at least one conductor 20. Different types of inorganic materials may be used, each of which may have different sizes or pose different constraints on construction of the cable 10. Furthermore, it may be advantageous to apply the inorganic tape 30 directly to the at least one conductor 20, or around the at least one conductor 20 but not in a direct abutting position. The inorganic tape 30 may be manufactured on an assembling line with any type of machine or apparatus wrapping or otherwise applying the inorganic tape 30 about the at least one conductor 20. All configurations and designs of the use of inorganic tapes 30 applied to the at least one conductor 20 are considered within the scope of the present disclosure.

The armor shell 40 is a sheath or exterior coating or layer that is applied to an exterior surface of the inorganic tape 30 and protects the inner components of the cable 10. Any material, substance or layer located on the exterior of the cable 10 and capable of protecting the cable 10 may be considered an armor shell 40. The armor shell 40 may be substantially concentric to the at least one conductor 20 and constructed from a strong material, such as a stainless steel or Incoloy. The armor shell 40 may protect the cable 10 from foreign objects penetrating the cable 10, such as debris from a drilling process. The armor shell 40 may also include any woven, solid, particulate-based and layered protecting materials. In some instances, such as illustrated in FIG. 1, the inorganic tape 30 may be the only material between the at least one conductor 20 and the armor shell 40. However, other materials and layers of materials may optionally be used with the cable 10. For example, an organic tape, such as a polyimide tape may be used as the last layer of the cable 10, interior of the armor shell 40, to increase insulation resistance (IR) at lower temperatures and to aid with manufacturing of the cable 10.

In operation, the cable 10 may be placed vertically, wherein one end of the cable 10 is substantially above the other end of the cable 10. This may include a cable 10 with any length, such as 100 feet, 300 feet, 500 feet or greater or any other length. For example, the cable 10 may be suspended within a hole drilled within the Earth's crust, wherein one end of the cable 10 is located above the Earth's crust and the other end is located 500 feet or more below the Earth's crust. The cable 10 may be held in this position for any period of time. As the cable 10 is used, the inorganic tape 30 may shield the at least one conductor 20 from environmental heat, such as heat from work conditions, tools, or other sources of heat. For example, friction from a drilling operation may create a substantial amount of heat that may be transferred through the environment, e.g., water or air, to the cable 10. The inorganic tape 30 may shield the at least one conductor 20 from damage that may normally occur with conventional cables. As one having ordinary skill in the art would recognize, many variations, configuration and designs may be included with the cable 10, or any component thereof, all of which are considered within the scope of the disclosure.

Figure 2:
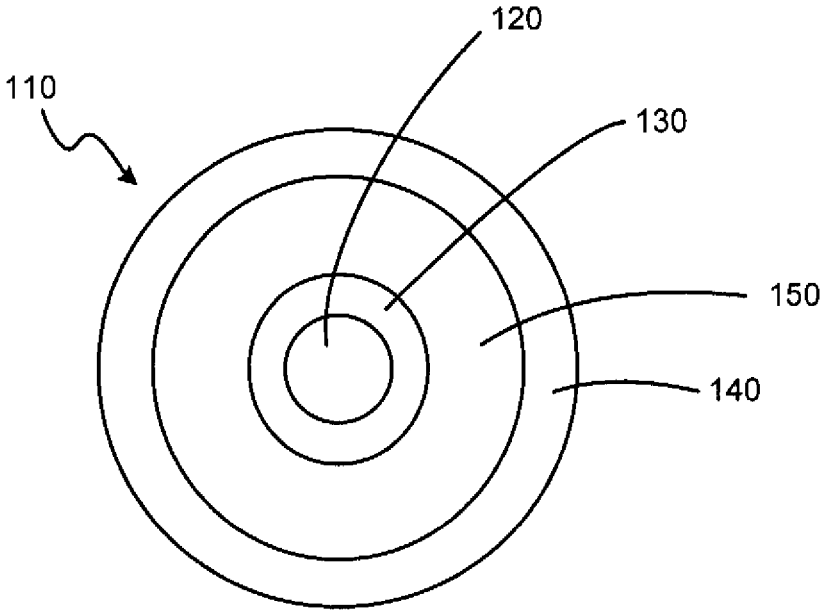
FIG. 2 is a cross-sectional illustration of a high-temperature cable, in accordance with a second exemplary embodiment of the present disclosure.

FIG. 2 is a cross-sectional illustration of a high-temperature cable 110, in accordance with a second exemplary embodiment of the present disclosure. The high-temperature cable 110, which may be referred to simply as 'cable 110,' is substantially similar to the cables described in the other embodiments of this disclosure, and may include any of the features discussed relative to those embodiments. The cable 110 includes at least one conductor 120. An inorganic tape 130 is wrapped around the at least one conductor 120. An armor shell 140 is applied to the exterior of the inorganic tape 130. In addition, an inorganic layer 150 constructed, at least partially from at least one of glass, etched glass, and ceramic, is included with the cable 110.

The cable 110 is similar to that of the cable 10 of the first exemplary embodiment, and includes at least one conductor 120 located about a central axis of the cable 110. An abutting inorganic tape 130 encapsulates the at least one conductor 120. An armor shell 140 is applied to the exterior of the inorganic tape 130 and traverses the circumference of the cable 110. The use of the inorganic layer 150 with the inorganic tape 130 may provide further thermal protection of the at least one conductor 120. The inclusion of the inorganic layer 150 of glass, etched glass, or ceramic may be especially useful for applications of 250° C. to 1000° C., but may also be used for temperatures below 250° C. and above 1000° C. The inorganic layer 150 may be positioned between the inorganic tape 130 and the armor shell 140, as is shown in FIG. 2, or positioned at other locations within the cable 110, as is discussed relative to other embodiments of this disclosure.

The inorganic layer 150 may be constructed from glass, etched glass, or ceramic. This inorganic layer 150 may be used to provide additional protection to the inner materials of the cable 110, however it may not be required on some cables 110 (such as that described in FIG. 1), since the armor sheath 140 provides protection as well. Thus, the use of the inorganic layer 150 may depend on the intended use of the cable 110 and/or the surrounding environment of use. In accordance with this disclosure, the glass, etched glass, and ceramic may include any similar materials or combinations thereof, all of which are included within the scope of the present disclosure.

Figure 3:
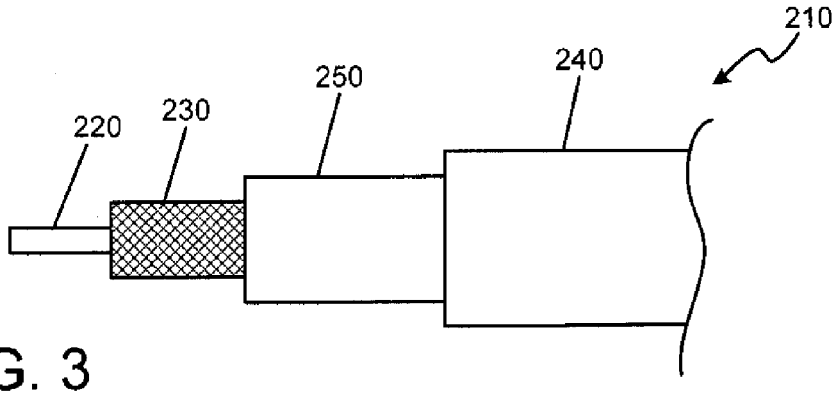
FIG. 3 is a plan view illustration of a high-temperature cable, in accordance with a third exemplary embodiment of the present disclosure.

FIG. 3 is a plan view illustration of a high-temperature cable 210, in accordance with a third exemplary embodiment of the present disclosure. The high-temperature cable 210, which may be referred to simply as 'cable 210,' is substantially similar to the cables described in the other embodiments of this disclosure, and may include any of the features discussed relative to those embodiments. The cable 210 includes at least one conductor 220. A braided inorganic tape 230 is wrapped around the at least one conductor 220. An armor shell 240 is applied exterior of the braided inorganic tape 230. An inorganic layer 250 is positioned between the braided inorganic tape 230 and the armor shell 240. The braided inorganic tape 230 may be formed from inorganic materials that are braided or woven to form a substantially unitary structure. The braided or woven structure may be applied about the conductor 220 with a rotary machine or other device, which allows the braided inorganic tape 230 to be securely positioned on the conductor 220. The benefits of the braided inorganic tape 230 may include easier manufacturing of the cable 210 and better protection of the conductor 220 from heat, as well as other benefits.

Figure 4:
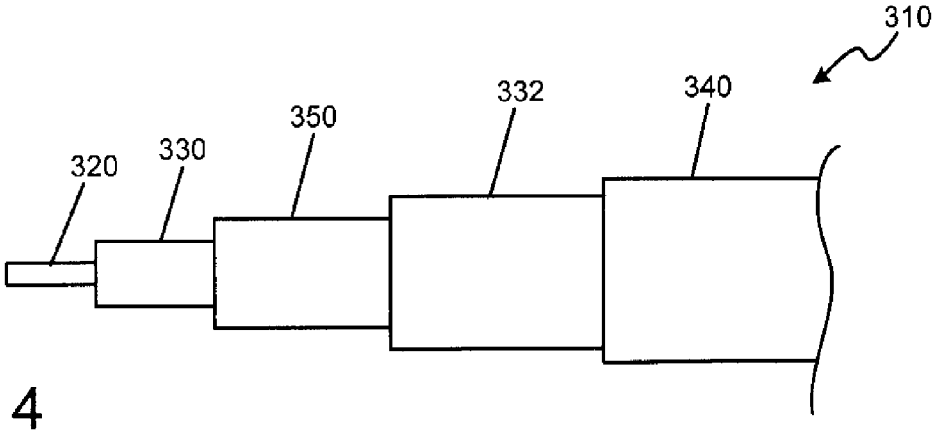
FIG. 4 is a plan view illustration of a high-temperature cable, in accordance with a fourth exemplary embodiment of the present disclosure.

FIG. 4 is a plan view illustration of a high-temperature cable 310, in accordance with a fourth exemplary embodiment of the present disclosure. The high-temperature cable 310, which may be referred to simply as 'cable 310,' is substantially similar to the cables described in the other embodiments of this disclosure, and may include any of the features discussed relative to those embodiments. The cable 310 includes at least one conductor 320. An inorganic tape 330 is wrapped around the at least one conductor 320. An armor shell 340 is applied exterior of the inorganic tape 330. A second or additional inorganic tape 332 is also included with the cable 320. An inorganic layer 350 is positioned between the inorganic tape 330 and the second inorganic tape 332.

Any number of inorganic tape 330 sections or inorganic layers 350 may be included with the cable 310. In FIG. 4, the cable 310 is shown with an inorganic layer 350 that is sandwiched between two inorganic tape sections 330, 332. The use of varying configurations of inorganic tapes 330, 332 and inorganic layers 350 may be selected based on the use of the cable 310 and the thermal protection needed. For example, with cable 310 used in environments that include high temperature exposures, such as temperatures approaching 1,000° C. or higher, may require a cable 310 that includes a number of layers of inorganic tape 330, 332 and inorganic layers 350. All configurations of using inorganic tape 330, 332 sections and inorganic layers 350 are considered within the scope of the present disclosure.

Figure 5:
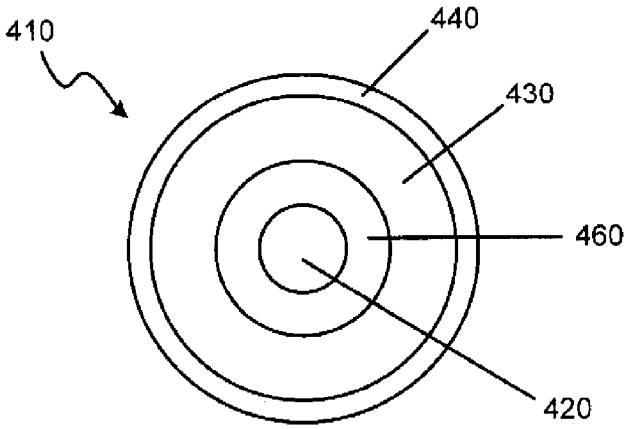
FIG. 5 is a cross-sectional illustration of a high-temperature cable, in accordance with a fifth exemplary embodiment of the present disclosure.

FIG. 5 is a cross-sectional illustration of a high-temperature cable 410, in accordance with a fifth exemplary embodiment of the present disclosure. The high-temperature cable 410, which may be referred to simply as 'cable 410,' is substantially similar to the cables described in the other embodiments of this disclosure, and may include any of the features discussed relative to those embodiments. The cable 410 includes at least one conductor 420. An inorganic tape 430 is wrapped around the at least one conductor 420. An armor shell 440 is applied exterior of the inorganic tape 430. An insulation layer 460 is also included in the cable 410. The insulation layer 460 may be positioned interior of the inorganic tape 430 and abutting the conductor 420, or positioned exterior to an inorganic tape 430 but interior of another layer of inorganic material or tape, as is discussed relative to FIG. 4.

Figure 6:
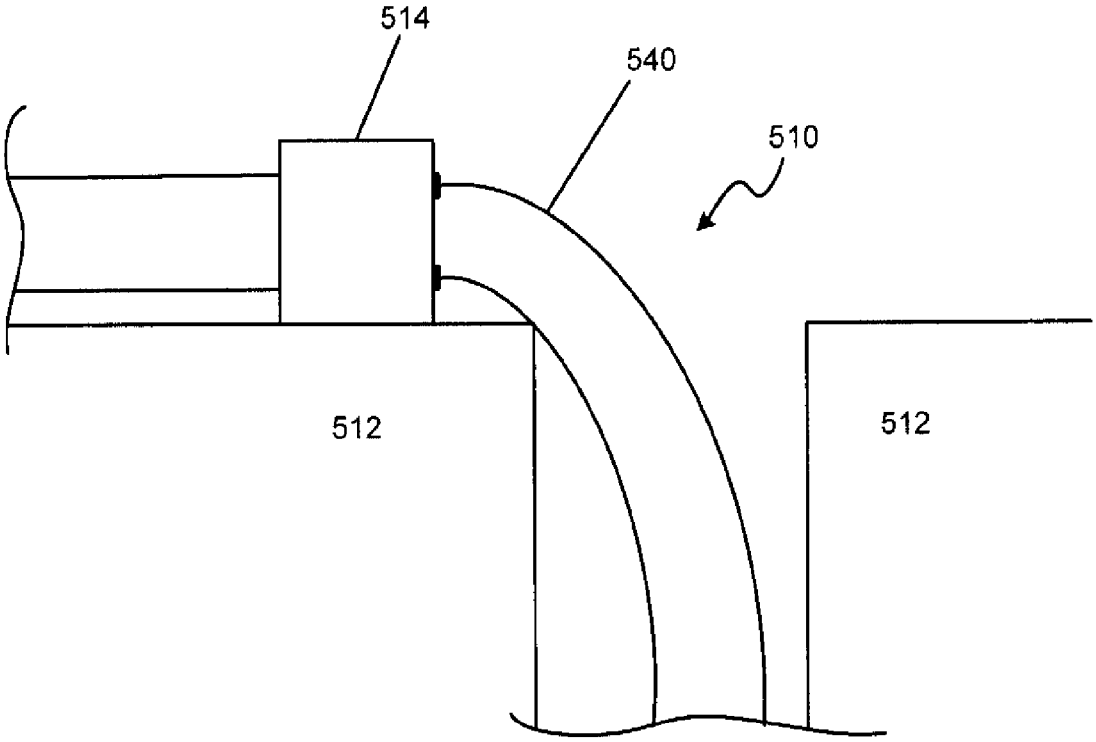
FIG. 6 is a plan view illustration of a high-temperature cable in an installed position, in accordance with a sixth exemplary embodiment of the present disclosure.

FIG. 6 is a plan view illustration of a high-temperature cable 510 in an installed position, in accordance with a sixth exemplary embodiment of the present disclosure. The high-temperature cable 510, which may be referred to simply as 'cable 510,' is substantially similar the cables described in the other embodiments of this disclosure, and may include any of the features discussed relative to those embodiments. Although not shown, the cable 510 includes at least one conductor and an inorganic tape wrapped around the conductor. An armor shell 540 is applied exterior of the inorganic tape. The armor shell 540 may be used to support the cable 510 to a supporting structure 514, such as an anchoring post or other anchoring structure. With one end of the cable 510 anchored to the supporting structure 514, the cable 510 may be positioned substantially vertically within the Earth 512. For example, this use of the cable 510 may be commonly seen when the cable 510 is used with down-hole drilling operations. Anchoring the armor shell 540 to the supporting structure 514 may allow for the weight of the cable 510 to be properly supported without damaging the inner components of the cable 510.

Figure 7:
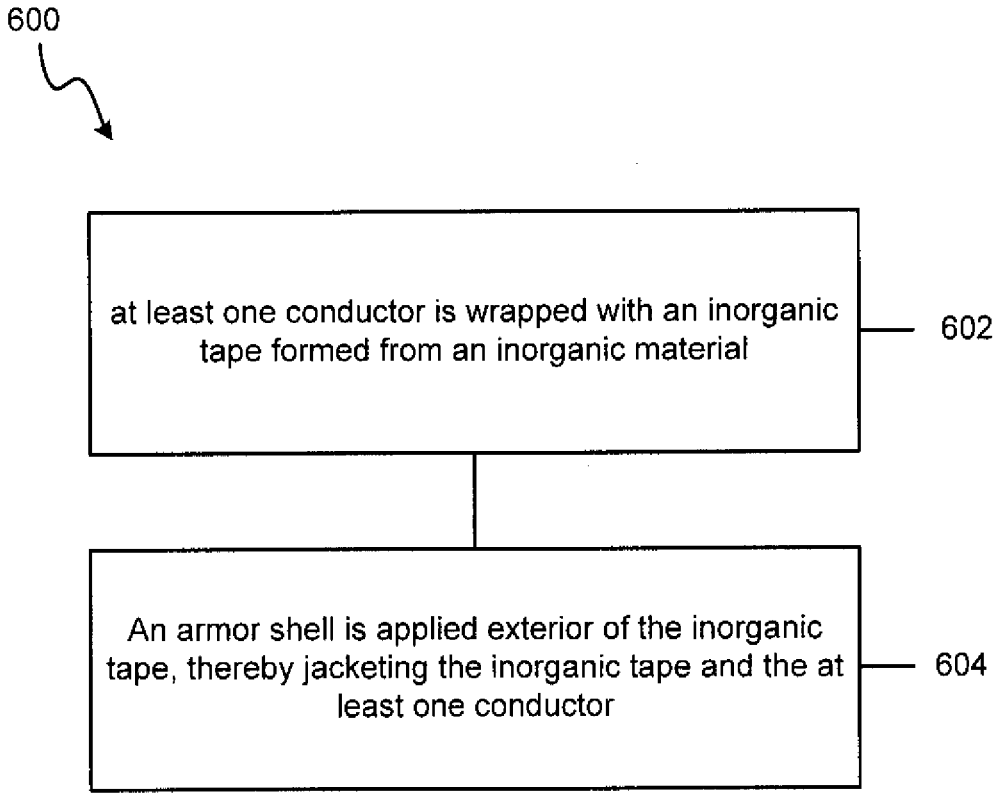
FIG. 7 is a flowchart illustrating a method of making a high-temperature cable in accordance with the first exemplary embodiment of the disclosure.

FIG. 7 is a flowchart 600 illustrating a method of making a high-temperature cable 10 in accordance with the first exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 602, at least one conductor is wrapped with an inorganic tape formed from an inorganic material. An armor shell is applied exterior of the inorganic tape, thereby jacketing the inorganic tape and the at least one conductor (block 604). In addition, the method may include any of the steps, processes, or functions described with respect to FIGS. 1-6. For example, the method may also include a heat treatment, such as subjecting the cable 10, or any of the materials therein, to a high-temperature environment to bake off any organic materials that are used in a manufacturing process. When in use, the cable may be subjected to an external heat source, wherein the inorganic tape prevents thermal damage to the at least one conductor. The external heat source may be greater than 250° C., between 250° C. and 550° C., or greater than 550° C. An inorganic layer may be applied between the at least one conductor and the armor shell, such as positioned between the inorganic tape and the armor shell. When the cable is subjected to the external heat source, the inorganic tape and inorganic layer may prevent thermal damage to the at least one conductor. For example, the inorganic tape and inorganic layer may prevent damage with temperatures between 250° C. to 1,000° C., or greater than 1,000° C.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A high-temperature cable comprising:

at least one conductor;

an inorganic tape wrapped around the at least one conductor;

an armor shell applied exterior of the inorganic tape, wherein the armor shell has a nickel content of less than 89.50%; and an inorganic layer formed from etched glass, wherein the inorganic layer is positioned between the inorganic tape and the armor shell.

2. The high temperature cable of claim 1, wherein the inorganic layer is positioned directly between the inorganic tape and the armor shell, wherein the inorganic layer formed from etched glass is abutting both the inorganic tape and the armor shell.

3. The high-temperature cable of claim 1, wherein the inorganic layer protects the conductor from an external heat source, wherein the external heat source is greater than 250° C.

4. The high-temperature cable of claim 3, wherein the external heat source is greater than 1,000° C.

5. The high-temperature cable of claim 1, wherein the inorganic tape further comprises a braid structure.

6. The high-temperature cable of claim 1, wherein the inorganic tape is positioned directly abutting the at least one conductor.

7. The high-temperature cable of claim 1, further comprising:

a second inorganic tape wrapped around the at least one conductor, wherein the inorganic layer formed from etched glass is positioned between the inorganic tape and the second inorganic tape.

8. The high-temperature cable of claim 7, wherein the inorganic tape is positioned directly abutting the at least one conductor and an interior surface of the inorganic layer formed from etched glass, and wherein the second inorganic tape is positioned directly abutting an exterior surface of the inorganic layer formed from etched glass and an interior surface of the armor shell, wherein the armor shell is non-braided.

9. The high-temperature cable of claim 1, wherein the armor shell is anchored to a support structure.

10. The high-temperature cable of claim 1, further comprising an insulation layer positioned about the at least one conductor.

11. The high-temperature cable of claim 1, wherein the armor shell is directly abutting the inorganic tape wrapped around the at least one conductor.

12. The high-temperature cable of claim 1, wherein the armor shell having a nickel content of less than 89.50% further comprises stainless steel.

13. A method of making a high-temperature cable, the method comprising the steps of:

wrapping at least one conductor with an inorganic tape formed from an inorganic material;

applying an armor shell exterior of the inorganic tape, thereby jacketing the inorganic tape and the at least one conductor, wherein the armor shell has a nickel content of less than 89.50%; and positioning an inorganic layer formed from etched glass between the inorganic tape and the armor shell.

14. The method of claim 13, further comprising the steps of:

subjecting the at least one conductor, the inorganic tape, the inorganic layer formed from etched glass, and the armor shell to an external heat source; and preventing thermal damage to the at least one conductor with the inorganic tape and the inorganic layer formed from etched glass.

15. The method of claim 14, wherein the external heat source is greater than 250° C.

16. The method of claim 14, wherein the external heat source is between 250° C. and 1,000° C.

17. The method of claim 13, wherein positioning the inorganic layer formed from etched glass between the inorganic tape and the armor shell further comprises directly abutting the inorganic layer with the inorganic tape and the armor shell.

18. The method of claim 13, further comprising wrapping a second inorganic tape around the at least one conductor, wherein the inorganic layer formed from etched glass is positioned between the inorganic tape and the second inorganic tape.

19. A high-temperature cable comprising:

at least one conductor;

an inorganic tape wrapped around the at least one conductor;

an armor shell applied exterior of the inorganic tape, wherein the armor shell has a nickel content of less than 89.50%; and an inorganic layer formed from ceramic, wherein the inorganic layer is positioned between the inorganic tape and the armor shell.

* * * * *